United States Patent [19]

Roche et al.

[11] 4,024,718

[45] May 24, 1977

[54] SUBSEA CABLE APPARATUS AND METHOD OF HANDLING SAME

[75] Inventors: Joseph R. Roche; Frank Allan Bryant, both of Houston, Tex.

[73] Assignee: The Offshore Company, Houston, Tex.

[22] Filed: Dec. 18, 1975

[21] Appl. No.: 642,137

[52] U.S. Cl. ..... 61/69 R; 61/86; 114/258; 166/.5; 175/7

[51] Int. Cl.[2] ..... E21B 15/02; E21B 33/035

[58] Field of Search ..... 61/46.5, 46, 72.3, 63, 61/69 R; 166/.5, .6; 114/43.5, .5 D, .5 F; 175/7

[56] References Cited

UNITED STATES PATENTS

| | | | |
|---|---|---|---|
| 3,163,222 | 12/1964 | Foster et al. | 166/.6 |
| 3,332,484 | 7/1967 | Watkins | 166/.6 |
| 3,378,086 | 4/1968 | Kirisild | 175/7 |
| 3,493,043 | 2/1970 | Watkins | 166/.5 |
| 3,517,738 | 6/1970 | Petersen | 166/.6 |
| 3,675,713 | 7/1972 | Watkins | 166/.6 |
| 3,709,291 | 1/1973 | Hanes et al. | 166/.5 |
| 3,945,213 | 3/1976 | Forbes et al. | 61/69 R |

*Primary Examiner*—Dennis L. Taylor
*Attorney, Agent, or Firm*—Vinson & Elkins

[57] ABSTRACT

Subsea cable apparatus adapted to extend from a floating structure to a subsea wellhead apparatus or stack with a marine riser pipe extending from the floating structure to the subsea wellhead, such apparatus including a cable supported on the floating structure, by a multiple roller sheave with an integral load cell for measuring tension in the cable, a clamp on the riser pipe adapted to engage the cable to support it, the cable between the clamp and the floating structure forming a free catenary loop, means for engaging and disengaging said clamp on said cable, remote, diverless means for disconnecting said clamp from said riser pipe, a telescoping connection in the lower end of said cable to absorb the shock of landing control pod attached to the lower end of the cable on the pod receptacle on the subsea wellhead apparatus and to compensate for relative movement between the cable and the subsea wellhead stack, a pod connector on the lower end of the cable, a mating pod receptacle connector on the subsea wellhead apparatus, and means for latching the connectors in mated engagement. The method of handling the cable apparatus for installation includes the steps of lowering the cable and pod and landing the pod connector on the subsea wellhead pod female receptacle, latching the pod connector in landed position, inserting the cable in the clamp, lowering and securing the clamp to the marine riser pipe, setting the clamp slips, inserting the cable in a support shoe above the clamp, supporting the cable between the clamp shoe and the floating structure in a free catenary loop, and for recovery includes the steps of retrieving the support shoe, disengaging the clamp from the cable, remotely retrieving and removing the clamp, releasing the pod latch, and raising the cable, and pod to the floating structure.

13 Claims, 6 Drawing Figures

SUBSEA CABLE APPARATUS AND METHOD OF HANDLING SAME

BACKGROUND OF THE INVENTION weight of

In the drilling of subsea wells, armored cable is used to provide electrical and hydraulic control lines from the floating structure, such as a drilling platform, to the blowout-preventer stack at the subsea wellhead. Considerable difficulties have been encountered because of the relative movement between the subsea wellhead and the floating structure which have damaged the cables. Such cables are very expensive so that damage to them is costly. The recovery of a damaged cable and resetting of a new cable are time consuming which further increases the cost of such cable damage. Also, it has been found that such armored cables have been damaged as a result of the shock of landing the lower end of the cable on the subsea wellhead apparatus.

SUMMARY

The present invention relates to a subsea cable apparatus and to a method of handling the cable apparatus to lower the cable into installed position and to raising the cable for recovery.

An object of the present invention is to provide an improved subsea cable apparatus which has improved protection against cable damage while the cable is being installed, retrieved, or in use.

Another object is to provide an improved subsea cable apparatus having supports which allow relative movement between the supports without subjecting the cable to additional stress.

A further object is to provide an improved subsea cable motion compensating apparatus which protects the cable from damage due to shock on landing on the subsea wellhead apparatus.

Another object is to provide an improved subsea cable handling method and apparatus in which a preselected tension may be maintained on the cable.

Another object is to provide an improved method of handling a subsea cable for its installation and recovery.

The improved subsea cable apparatus provides improved supports on the floating structure and on the riser pipe which allow the cable to hang in a free catenary loop to avoid stressing or buckling the cable when there is relative movement between the floating structure and the subsea cable termination. Also, this apparatus provides an improved support for releasably gripping the cable and supporting the weight of the cable extending to the subsea wellhead. Such support is releasably connected to the riser pipe so that it may be retrieved. The lower end of the subsea cable connects to the retrievable control pod which latches to the receptacle on the wellhead apparatus. This latch is controlled from the surface. To cushion the shock of landing, the apparatus includes a telescoping connection in the lower end of the subsea cable with an unarmored, flexible cable bypass therearound.

The improved method of handling the subsea cable for installation includes the set step lowering the pod on the cable, landing the lower end on the subsea wellhead apparatus and latching it thereon, cushioning the landing to protect the cable from shock, securing the upper end of the cable to the marine riser while maintaining a preselected tension in the cable, and supporting the cable in a free catenary loop to protect it from relative movement between the floating structure and the subsea cable termination. The method of handling the subsea cable for recovery includes the steps of releasing the clamping engagement of the clamp on the cable recovering the clamp from the riser pipe, unlatching the pod, and raising the cable and pod to the floating structure.

BRIEF DESCRIPTION OF THE DRAWINGS

These and other objects and advantages are hereinafter set forth and described with reference to the drawings wherein.

DESCRIPTION OF THE PREFERRED EMBODIMENTS

Figure 1:
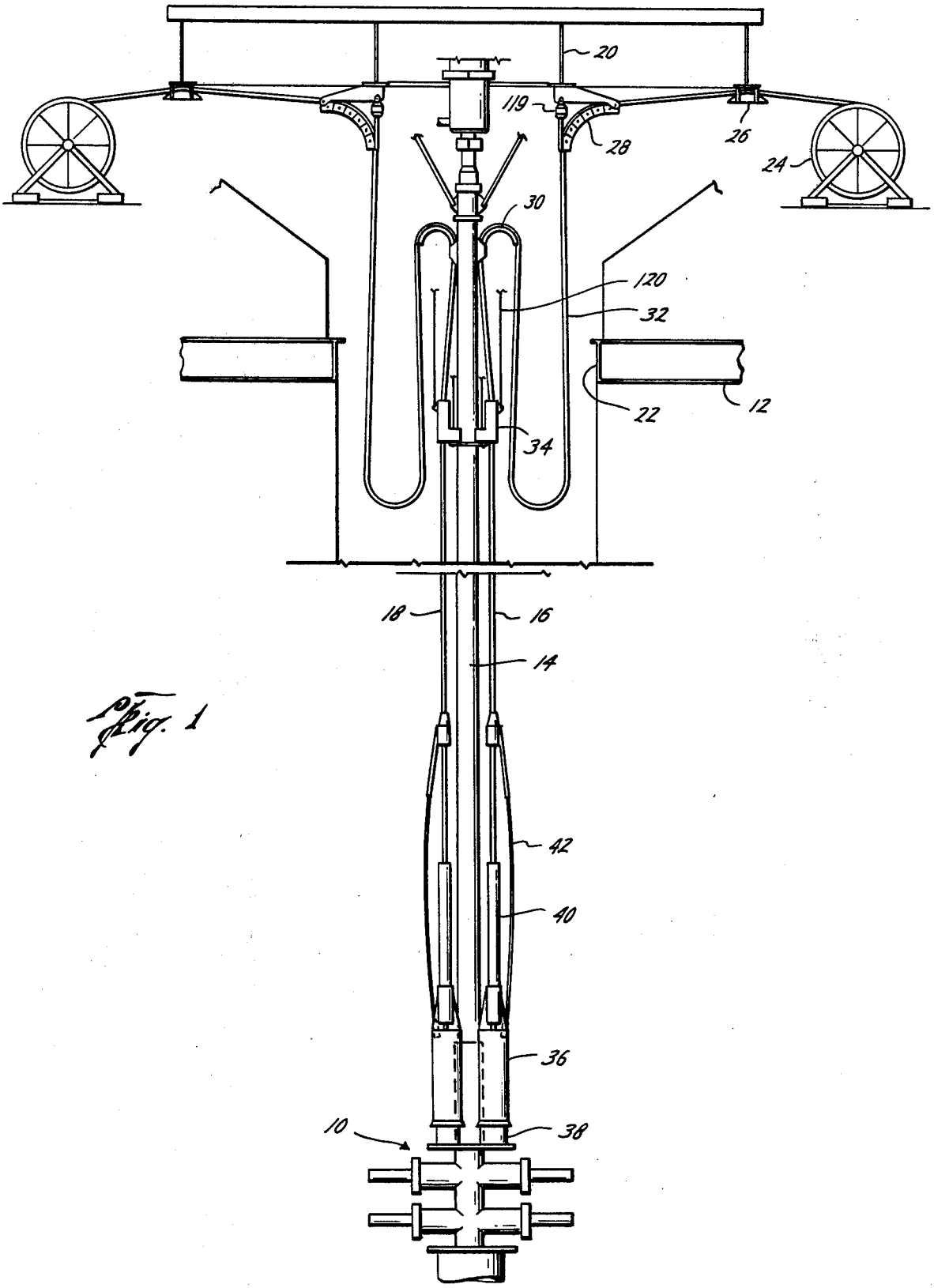
FIG. 1 is an elevation view of a floating structure above a subsea wellhead with a riser pipe connecting from the wellhead apparatus to the floating structure and including the improved subsea cable apparatus of the present invention.
Figure 2:
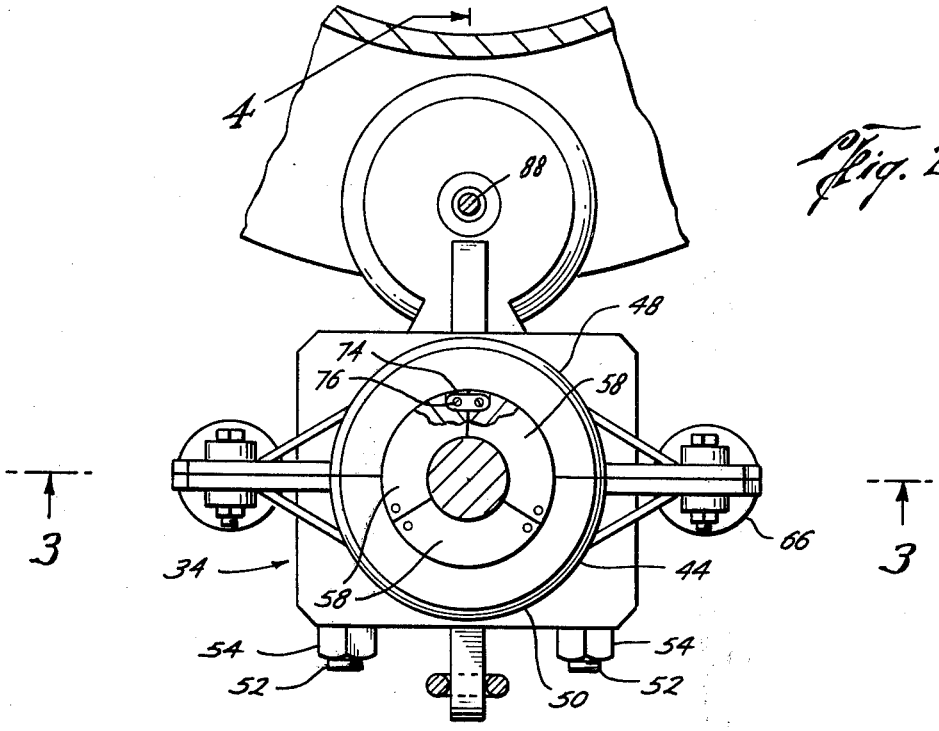
FIG. 2 is a plan view of the cable support clamp on the riser pipe.
Figure 3:
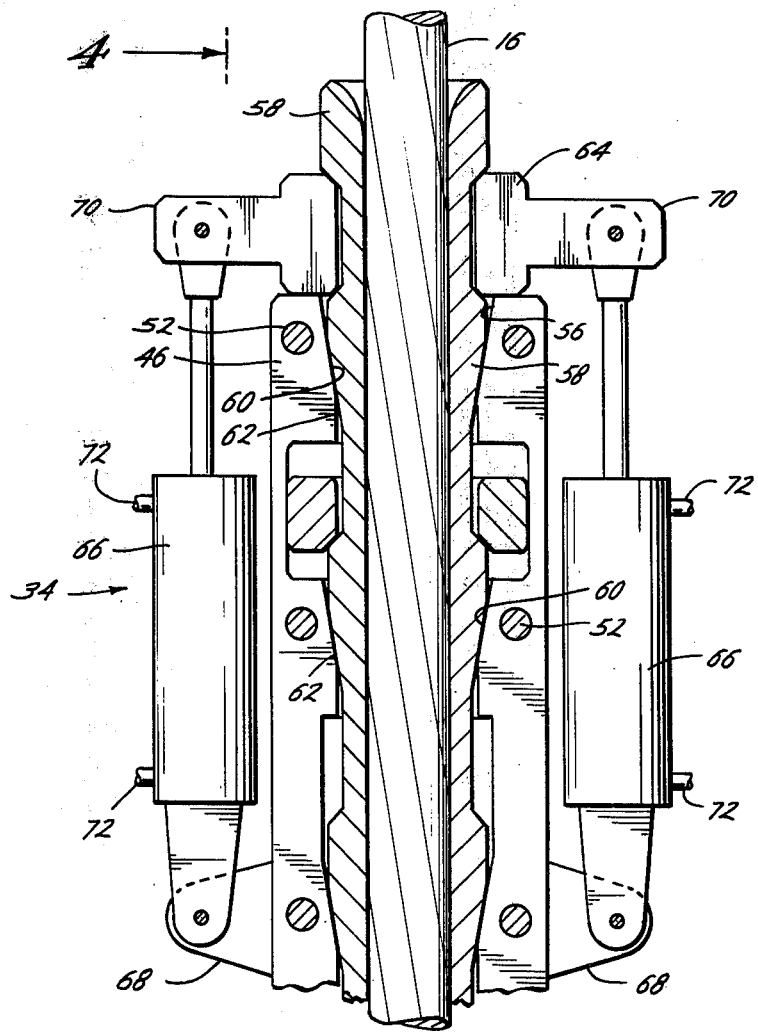
FIG. 3 is a sectional view taken along line 3—3 in FIG. 2 to illustrate the means for operating the cable engaging means.

The improved subsea cable apparatus of the present invention is shown in FIG. 1 together with the subsea well-head apparatus 10, the floating structure 12 and the riser pipe 14 which extends from the subsea well-head apparatus 10 to the floating structure 12. Two subsea cables 16 and 18 are shown in the preferred embodiment of the present invention with one of the cables being used to provide electrical and hydraulic connections from the floating structure 12 to the subsea wellhead apparatus 10 and the other of such cable functioning as a back-up unit in case there is a failure in the first cable or its related subsea equipment. This back-up system of using two cables allows one of the cables to be recovered, serviced and reinstalled without the necessity of shutting down operations dependent upon the operability of the cable. The apparatus for supporting, handling and protecting each of the cables is preferred to be the same so only one of the cables and its apparatus is hereinafter described.

The floating structure 12 includes a derrick 20 which is positioned over the moon pool opening 22 in structure 12 through which riser pipe 14 extends. The cable reel 24 is supported by the derrick and the cable 16 extends therefrom over the ramp 26 and the roller sheave 28. Ramp 26 and roller sheave 28 are shaped to provide a smooth support for cable 16. Suitable means on the roller sheave 28 is provided to directly measure the tension in cable 16. Such means may be the load cell 119.

The cable 16 extends from the roller sheave 28, which mounted on the derrick 20, to the cable shoe 30 which is mounted on riser pipe 14. In order to protect the cable against relative movement between the floating structure 12 and the riser pipe 14, the cable 16 is supported in the free catenary loop 32 as shown in FIG. 1. As can be seen both cable shoe 30 and roller sheave 28 are formed to provide a smooth, non-kinking support for the cable 16 at each end of the loop 32. Below shoe 30, cable 16 extends through the support clamping means 34. The clamping means 34 is releasably connected to the riser pipe 14 as hereinafter described.

The cable 16 extends downward below clamping means 34 in generally parallel relationship to riser pipe 14 and is connected to the subsea wellhead apparatus by the mating connector pods 36 and 38. A suitable remote controlled latching means is provided to releasably secure the connectors 36 and 38 in their mated position.

Since the cable 16 is very heavy, it needs to be protected against the shock which occurs when it is landed on the subsea wellhead apparatus as a result of the movement of the floating structure. The telescoping connection 40 is connected into the lower end of cable 16 immediately above the connector 36 and the cable bypass conduit 42 provides communication for all of the elements of cable 16 and extends from the cable 16 above the connection 40 to the connector 36. Bypass conduit 42 is of sufficient length to allow full range of movement of the telescoping connection 40.

The details of the support clamping means 34 are shown in FIGS. 2 through 5. The clamping means 34 includes the clamp 44 having a body 46 composed of two segments 48 and 50 which are joined by the studs 52 and nuts 54. The body 46 defines a longitudinal opening 56 in which the segmented gripping elements or slips 58 are positioned. The inwardly and downwardly coverging surfaces 60 on the interior of body 46 engage the mating tapered surfaces 62 on the exterior of the slips 58. The tapers on surfaces 60 and 62 coact so that when slips 58 are lowered they are forced into gripping engagement with the cable 16. Raising of the slip 58 allows disengagement of the slips 58 from the cable 16. The exterior of slips 58 above body 46 is recessed to receive the release sleeve 64. Hydraulic actuators 66 are connected to the lugs 68 on body 46 and connect to the ears 70 on the release sleeve 64. The actuators 66 move the slips 58 vertically to bring the slips 58 into clamping engagement with the cable 16 and to release the slips 58 from such engagement. The lines 72 conduct hydraulic fluid to the hydraulic actuators 66 to allow remote control of the clamp 44. The slips 58 are retained together by the links 74 which have oblong openings near each end through which the retainer pins 76 extend. Retaining ring 75 is positioned within the recess 77 in body 46 around slips 58.

When the cable 16 is being retrieved, the clamp 44 may be recovered so that the entire cable 16 including the telescoping connection 40 and connector 36 may be raised to the floating structure 12 since such components of the cable apparatus could not be pulled through the clamp 44.

Figure 4:
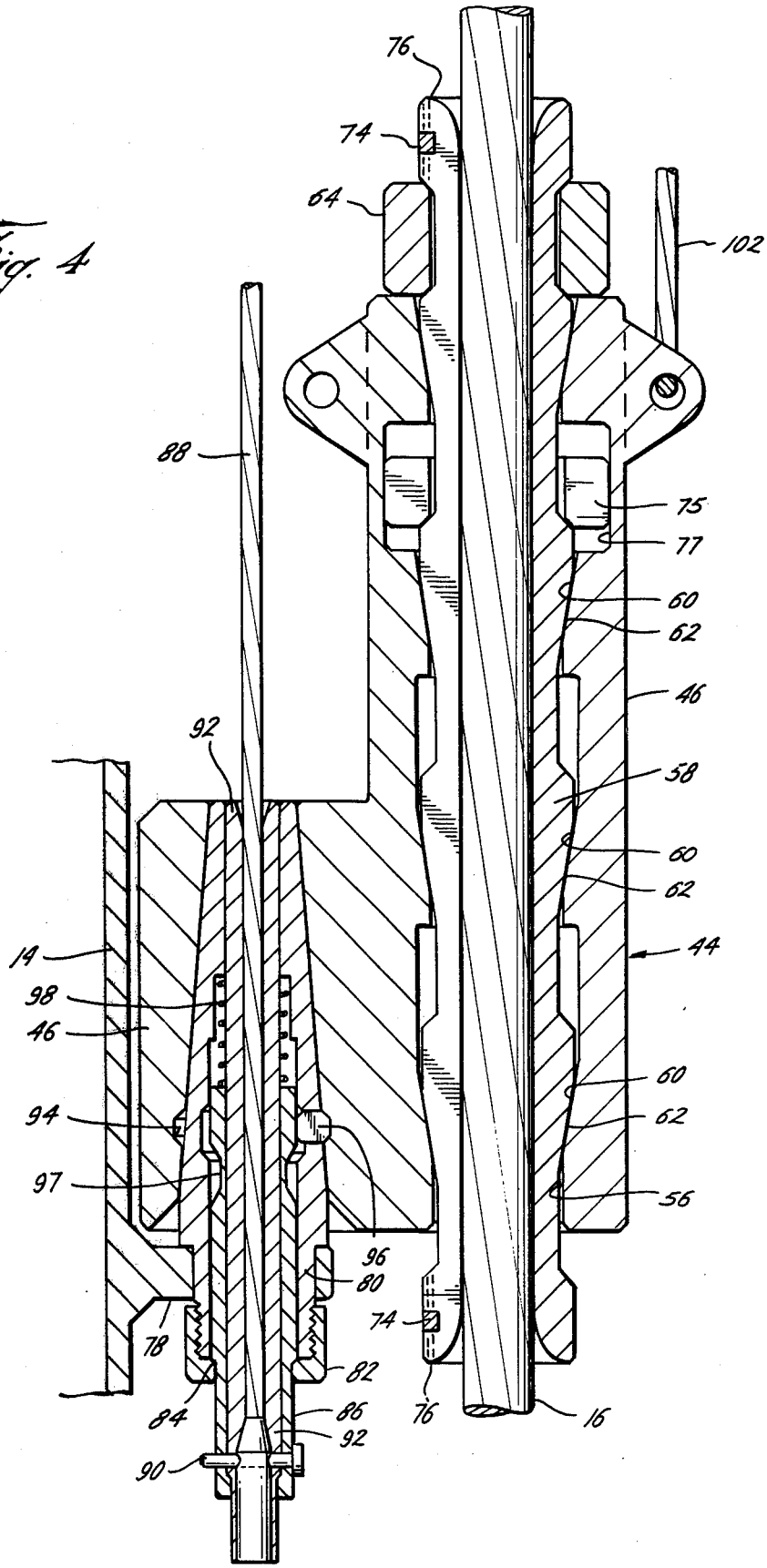
FIG. 4 is a sectional view taken along line 4—4 in FIG. 2 to illustrate the clamp latch securing the clamp to the riser pipe.
Figure 5:
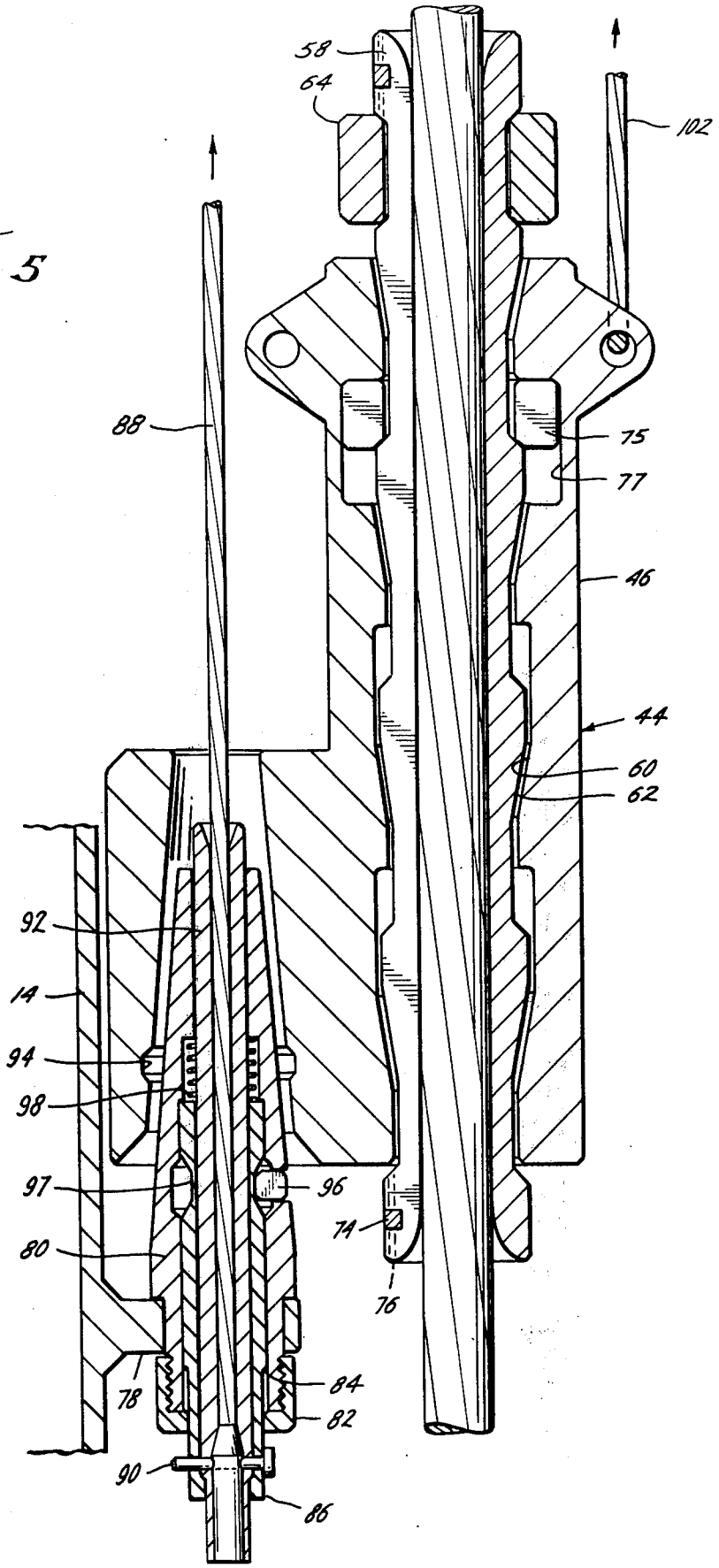
FIG. 5 is a sectional view similar to FIG. 4 showing the release of the clamp latch allowing recovery of the clamp.
Figure 6:
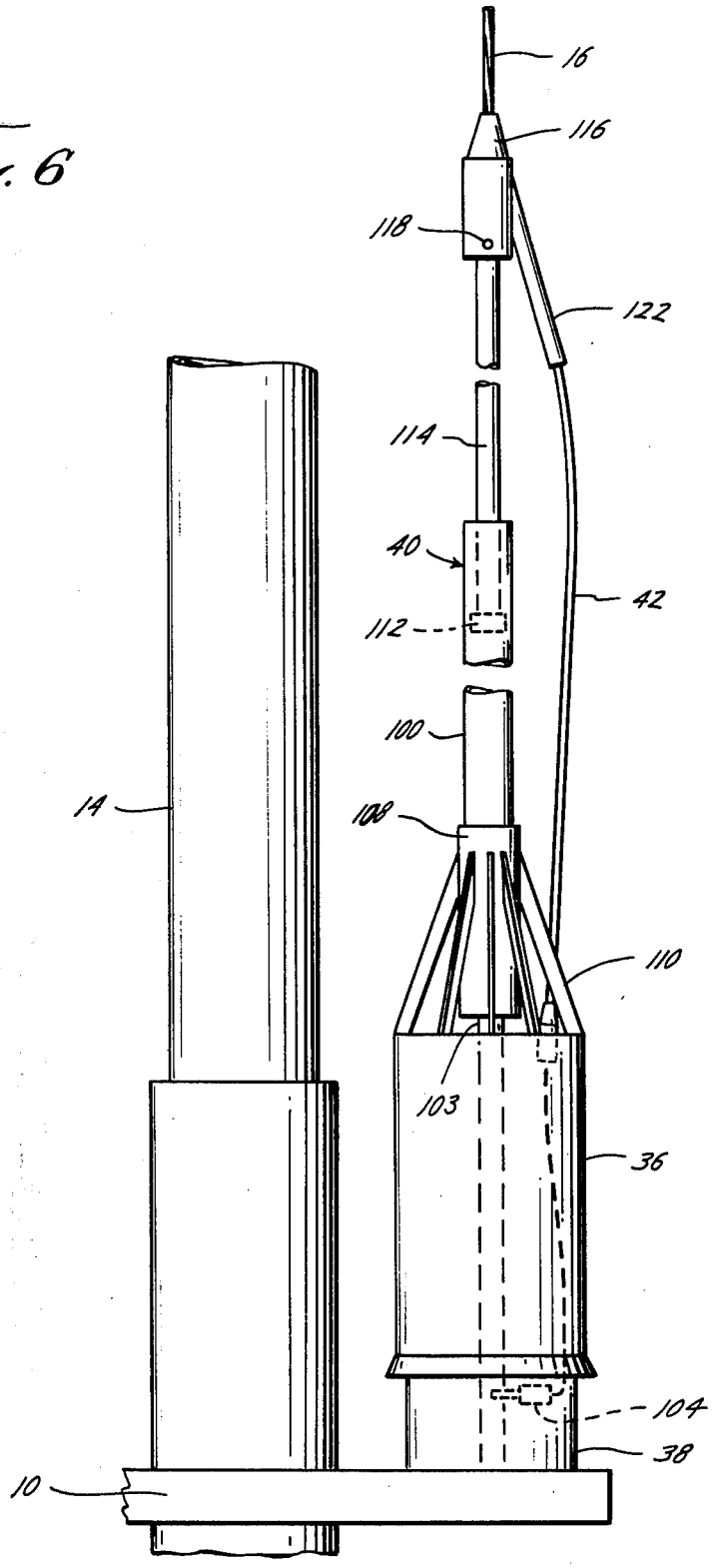
FIG. 6 is a detail elevation view of the mating connectors, their latch and the telescoping joint on the lower end of the cable.

The support for clamp 44 is secured to the flange 78 on riser pipe 14. As shown in FIGS. 4 and 5, the latch body 80 extends through the opening in flange 78 and is secured therein by the nut 82 which is threaded onto the lower end of latch body 80. Nut 82 projects inwardly and is adopted to engage the shoulder 84 on the latch sleeve 86. Latch sleeve 86 is supported on release cable 88 by connection of pin 90 which extends through collar 92 that is secured on the end of cable 88. The clamp body 46 has a downwardly diverging opening adapted to be positioned in surrounding relationship to latch body 80. The groove 94 defined in the walls of body 46 defining such opening is positioned to receive the segmented latching elements or dogs 96 as shown in FIG. 4. The elements 96 are retained in groove 94 by the engagement of sleeve 86 with the inner surface of the elements 96. In such position the clamp body 46 is secured to the riser pipe flange 78. Sleeve 86 is biased downwardly to latching position by the spring 98.

When recovery of the clamp 44 is desired, the release cable 88 is pulled to position the groove 97 in sleeve 86 opposite the latching elements 96. Thereafter, the clamp 44 may be retrieved, guided by the release cable 88.

As hereinbefore mentioned, the telescoping connection 40 is positioned on the lower end of the device near the mating connector 36 which mates with the connector 38 positioned on the subsea wellhead apparatus. Such subsea wellhead apparatus is normally a blowout preventer stack. The connector 38 in the illustrated embodiment is a female connector and the connector 36 is a male connector having direct engagement with the female connector. The latch rod 102 extends through the connector 36 and into the recess defined in the connector 38 wherein it is secured in position by the remotely actuated latch 104. Suitable plugs (not shown) are included to provide both electrical and hydraulic connections from the cable 16 through the bypass conduit 42 into the connector 38. Since the connector 38 is permanently affixed to the subsea wellhead apparatus 10, direct connections are made from connector 38 to the structure which is controlled by the electrical and hydraulic lines.

The telescoping connection 40 is immediately above the connector 36 and includes the cylinder 106 which is supported in the support sleeve 108. Support sleeve 108 is secured to the upper end of the connector 36 by the braces 110. Piston 112, which is adapted to reciprocate within the cyliner 106, is connected by the rod 114 to the mechanical cable connection 116. Such cable connection includes a shear pin 118 as a safety factor so that the cable may be recovered from the telescoping connection. The conduit bypass 42 is provided with a conduit support 122 extending from the mechanical cable connection 116 and is free to flex therebelow.

Such telescoping connection functions to protect the cable from the repeated impacts which would be delivered to the cable upon the landing of the connector 36 and as a result of the heave of the floating structure 12. It is believed that such impacts would cause the cable to cycle from tension to buckling at each impact and subject it to damage. The telescoping connection 40 is thus designed to allow a smooth landing of the connector 36 in the connector 38 without subjecting the cable to such repeated impacts.

In operation, the cable 16 is initially completely wound on the cable reel 24 and is fed over the ramp 26 and the roller sheave 28 and also the cable shoe 30. Thereafter the connector 36, and the telescoping connection 40 are suitably mounted on the cable. After the last riser joint is lowered into the moon pool, the clamp 34 is mounted on the cable 16 and hydraulic lines 72 are connected to the hydraulic actuators 66. It should be noted that the cables 16 and 18 may initially be lowered with the subsea wellhead apparatus. The clamp is lowered into position so that the body 46 engages the latch body 80. The release cable 88 is lowered allowing spring 98 to shift sleeve 86 downward. The weight of the cable 16 is normally sufficient to set the clamp 44 on body 80. This cams latch elements 96 into groove 94 to latch clamp 44 in position. Thereafter, the hydraulic actuators 66 are actuated to raise the segmental gripping elements (slips) 58. A preselected cable tension is set by the reel 24 on the cable 16 as tension is measured by load cell 119. The latch 104 locks the mating connectors 36 and 38 in their engaged position. The gripping elements 58 are set by applying hydraulic pressure to the hydraulic actuators 66 to force the gripping elements 58 downward. After securing the cable 16 in the clamp 34, the shoe 30 is installed in place on the marine riser 14 enabling the cable 16 to be slacked at a safe bend radius forming a catenary loop in the moon pool opening 22. In this position the cable is fully connected and the clamp 44 is set to support the cable during operations.

Whenever it is desired that the cable be retrieved, the catenary loop slack is taken out of the cable by taking up on the cable reel 24, the shoe 30 is retrieved from the marine riser, the hydraulic actuators 66 are actuated to raise the segmental gripping elements 58, releasing the cable 16, and the clamp 44 is released from its mount by applying tension to the release cable 88 retracting the dogs 96. The clamp 44 is then retrieved to the surface using cable 120 to pull the clamp 44 along the cable 16. The clamp 44 is then disassembled and removed from the cable 16. Retrieval of the cable 16 and connector 36 to the surface is then accomplished by simply taking up on the reel 24.

In setting or installing of the cable apparatus, the release cable 88 is used as a guide for setting of the clamp 44. Suitable guides, not show, such as those used to land the subsea wellhead apparatus may be used to bring the connector 36 into mating engagement with the connector 38. Further, whenever one of cables 16 and 18 is out of service, the other may be used to continue all operations.

What is claimed is:

1. A subsea cable apparatus for use between a floating surface and a subsea wellhead apparatus comprising, means on the floating structure for retaining a length of armored cable, an armored cable extending from said floating structure to said subsea wellhead apparatus, means for connecting said cable to said subsea wellhead apparatus, and telescoping means including shock absorbing means connected to said cable and engageable with said subsea wellhead apparatus to absorb the shocks of landing the cable on said subsea wellhead apparatus.

2. An apparatus according to claim 1 wherein said telescoping means includes, a cylinder, and a piston adapted to reciprocate within said cylinder and to dampen the shock of landing impacts, one of said cylinder and said piston being connected to said cable and the other being connected to said subsea wellhead apparatus.

3. An apparatus according to claim 2 including a cable bypass conduit connecting from said cable above said telescoping connecting means to said subsea wellhead apparatus.

4. A subsea cable apparatus for use between a floating structure and a subsea wellhead apparatus which are connected by a riser pipe comprising, an armored cable supported on said floating structure, means on said riser pipe for supporting said armored cable, means for connecting said armored cable to said subsea wellhead apparatus, and means retaining said armored cable in a free catenary loop between said riser pipe and said floating structure to compensate for relative movement therebetween, said retaining means including arcuate means supporting said armored cable at both ends of said loop.

5. An apparatus according to claim 4 wherein said retaining means includes a roller sheave supporting said armored cable at one end of said loop, said support sheave having integral means for directly measuring the tension in the cable, and an arcuate support shoe supporting said armored cable at the other end of said loop.

6. An apparatus according to claim 5 including a reel on which said armored cable is adapted to be wound supported on said floating structure, and a ramp supporting said cable on said floating structure between said roller sheave and said reel.

7. A subsea cable apparatus for use between a floating structure and a subsea wellhead apparatus which are connected by a riser pipe comprising, an armored cable, means connecting one end of said armored cable to controls on said floating structure, means connecting the other end of said armored cable to said subsea wellhead apparatus, and clamping means secured to said riser pipe and having means for releasably engaging said armored cable to support said armored cable, said clamping means including, a body having a longitudinal opening extending therethrough, gripping segments positioned within said opening, and means for raising and lowering said gripping segments, the interior surface of said opening and the exterior surfaces of said gripping segments being tapered so that said segments are moved inward into clamping engagement with a cable extending therethrough when said segments are moved downward and said segments are free to disengage from clamping engagement with the cable when said segments are moved upward.

8. A subsea cable apparatus for use between a floating structure and a subsea wellhead which are connected by a riser pipe comprising, an armored cable, a cable reel on said floating structure from which said cable extends, a cable support releasably mounted on said riser pipe, said cable between said cable support and said structure being sufficiently long to form a free catenary to compensate for relative movement between the floating structure and said riser pipe, said cable support releasably engaging said cable for supporting the portion of said cable extending therebelow, means for releasing the engagement of said cable support on said cable, means for releasing said cable support from its mounting on said riser pipe, means for connecting the lower end of said cable to said subsea wellhead, a telescoping connection in said cable near its connecting means to said subsea wellhead, bypass conduit connecting said cable around said telescoping connection, said telescoping connection protecting said cable from the shock of landing the lower end of said cable on said subsea wellhead, said connecting means including mating male and female connectors, one of said connectors mounted on said subsea wellhead, the other of said connectors mounted on the end of said cable, and remote control latching means for securing said connectors together.

9. The method of handling a subsea cable in relation to a floating structure, a subsea wellhead apparatus having a receiving pod thereon, a clamp having cable engaging means and seat engaging means, and a riser pipe extending between the subsea wellhead apparatus and the floating structure and having a lamp landing seat including the steps of, landing the lower end of the cable on the receiving pod on the subsea wellhead apparatus and latching it thereon, and assembling the clamp around the cable, lowering the clamp into engagement with the riser pipe clamp landing seat, securing clamp to the riser pipe, and remotely setting the engaging means of the clamp into engagement with the cable after the lower end of the cable has been landed and latched on the wellhead pod.

10. The method according to claim 9 including the steps of, sensing the tension in said cable before the cable engaging means of the clamp have been set, and adjusting the tension in said cable until the sensed cable tension is equal to a preselected desired cable tension, the setting of said engaging means being performed while said preselected tension is maintained on said cable.

11. The method according to claim 9 including the step of, forming a free hanging catenary loop in said cable between the clamp and a cable support on the floating structure.

12. The method according to claim 9 including the step of, absorbing the shocks of landing of the cable on said subsea wellhead apparatus with a telescoping structure connected to the end of the cable to protect the cable.

13. The method of handling a subsea cable which extends from a floating structure to a clamp supported on the riser pipe extending from the floating structure to a subsea wellhead apparatus and from the clamp on the riser pipe to a releasable connection on a latching pod on the subsea wellhead apparatus including the steps of, unlatching the lower end of the cable from the latching pod on the subsea wellhead apparatus, releasing the clamp on the riser pipe from engagement with said cable, retrieving said clamp from said riser pipe, and retrieving said cable.

* * * * *